United States Patent [19]

Bolton et al.

[11] Patent Number: 4,632,021

[45] Date of Patent: Dec. 30, 1986

[54] AUTO-SET OSCILLATING LOUVER DESIGN

[75] Inventors: Theodore S. Bolton, Liverpool; Robert J. Whitwell, Nedrow, both of N.Y.

[73] Assignee: Carrier Corporation, Syracuse, N.Y.

[21] Appl. No.: 771,085

[22] Filed: Aug. 30, 1985

[51] Int. Cl.[4] ..... F24F 13/15

[52] U.S. Cl. ..... 98/40.3; 98/94.2

[58] Field of Search ..... 98/40.3, 94.1, 94.2, 98/121.2; 415/12.5

[56] References Cited

U.S. PATENT DOCUMENTS

| | | | |
|---|---|---|---|
| 3,390,542 | 7/1968 | Perry et al. | 98/94.2 |
| 3,431,748 | 3/1969 | Balton | 98/94.2 |
| 3,677,166 | 7/1972 | Sisk, Jr. et al. | 98/94.2 |
| 3,699,873 | 10/1972 | Irvin | 98/40.3 X |
| 4,492,094 | 1/1985 | Katayama | 98/94.2 |

FOREIGN PATENT DOCUMENTS

| | | | |
|---|---|---|---|
| 927134 | 5/1963 | United Kingdom | 415/125 |

*Primary Examiner*—Harold Joyce

*Attorney, Agent, or Firm*—Dana F. Bigelow

[57] ABSTRACT

An air sweep mechanism in the discharge opening of a room air conditioner is provided with an operator level to select a desired position of fixed orientation for the vanes. When the vanes subsequently arrive at the position so selected, the air sweep drive mechanism is automatically stopped to leave the vanes in that fixed orientation.

9 Claims, 5 Drawing Figures

AUTO-SET OSCILLATING LOUVER DESIGN

BACKGROUND OF THE INVENTION

This invention relates generally to vane structures for air discharge openings of air conditioning systems, and more particularly, to an oscillating mechanism for sweeping the vanes through an angle of extreme positions.

Room air conditioners conventionally include an outdoor section and an indoor section. The indoor section includes an evaporator and a fan for circulating the indoor air from a return air opening, across the evaporator coil, and out the discharge opening. The return air opening is normally much larger than the air discharge opening and is covered with a fixed lattice type grille to allow the flow of air while preventing the ingestion of foreign materials into the return air opening. The relatively smaller air discharge opening is normally covered with adjustable louvers and/or vanes which can be adjusted to selectively direct the flow of the conditioned air being discharged therefrom.

A common design for room air conditioners is to provide a return air opening which extends across most of the width and the height of the inner face of the unit. The air discharge opening is often located thereabove and is much smaller in height than the return air opening but extends across the same width. This design allows for the discharge stream of conditioned air to be spread across the room in a wide layer for wide distribution.

Another type of room air conditioner is the so-called "side discharge" unit wherein, rather than placing the air discharge port above the air intake port, it is placed at the side thereof. The width of the air discharge port is then necessarily limited, and the wide distribution across the room is therefore diminished. Such an arrangement does provide for increased efficiencies and reduced turbulence with quieter operational characteristics, however.

In such a "side discharge" design, the use of louvers or vanes is made to more effectively direct the flow of the conditioned air from the air discharge opening. They may be aligned vertically to adjust the flow in the horizontal plane, or horizontally to adjust the flow in the vertical plane or a combination of the two. A further air distribution enhancement feature is that of providing vanes which are automatically moved in a continuous pattern to sweep the discharge air stream in an oscillating manner across the room. However, even with the "swept" type vanes, it is desirable to selectively stop the sweeping motion at a desired position such that the air flow stream remains in that position for a period of time. For example, it may be desirable to direct all of the air flow to one location within a room rather than distributing it across the entire room. In such case, with the conventional air sweep design, it has been necessary to wait until the sweeping mechanism arrives at the desired position and then turn off the sweeping mechanism. This approach not only requires the operator to wait while the mechanism oscillates to the desired position, but also often results in the sweeping mechanism "coasting" beyond the desired position after it has been turned off. Another problem with this approach is that, since the sweeping vanes are often located behind other louvers or a grille structure, it may be difficult to recognize the particular orientation of the sweeping vanes at any one time.

It is, therefore, an object of the present invention to provide an improved air sweep mechanism for an air conditioning system.

Another object of the present invention is the provision in an air conditioning system for an air sweep mechanism which can be easily and efficiently set at a desired fixed orientation.

Yet another object of the present invention is the provision in an air sweep mechanism for setting the louvers for a desired fixed orientation without the necessity of waiting until the sweep mechanism arrives at that location.

Still another object of the present invention is the provision in an air sweep mechanism for visually observing the position at which the sweeping mechanism will stop and remain in a fixed orientation.

Another object of the present invention is the provision for an air sweep mechanism which is economical to manufacture and efficient and easy to use.

These objects and other features and advantages become more readily apparent upon reference to the following description when taken in conjunction with the appended drawings.

SUMMARY OF THE INVENTION

Briefly, in accordance with one aspect of the invention, there is provided a lever which is selectively adjustable at its one end to any desired position corresponding to the desired angular fixed orientation of the air flow stream. The lever is mechanically connected at its other end to a mechanism which is responsive to the angular position of the sweeping mechanism to stop the operation of the sweeping mechanism when the orientation of the air flow stream corresponds with that of the lever. In this way, the operator can set the lever at a position which he can observe to correspond to the intended orientation of the air flow path. The mechanism will then automatically stop at the proper position to allow the air flow stream to be so aligned.

By another aspect of the invention, the one end of the lever is slideably attached to a slider mechanism with an actuator arm attached thereto. The actuator is biased upwardly and has, near its lower end, an upwardly extending protrusion and, at its upper end, a damper for selectively engaging the air sweep driving mechanism. Frictionally engaging the upper side of the protrusion is a cam follower plate which oscillates transversely in response to rotation of the air sweep drive mechanism to sweep the vanes attached thereto. On the lower side of the cam follower plate there is a notch for receiving the protrusion if and when the slider and cam follower plate are transversely located relative to each other such that the protrusion and the notch are vertically aligned. When this occurs, the protrusion is biased upwardly into the notch to thereby allow the actuator damper to extend upwardly to the point where it engages the air sweep drive mechanism to thereby stop its further motion. In the alternative, if continuous sweeping motion is desired, the lever is moved to a position such that the protrusion is beyond the range of transverse movement of the notch to thereby prevent the actuator mechanism from operating.

In accordance with another aspect of the invention, there is formed, on the upper side of the cam follower plate, a cam follower box with opposed vertical sides. Projecting into the box is a cam member which is eccentrically attached to and rotated by the drive mechanism. As the cam member is rotated, its eccentric form engages the vertical sides of the cam follower box so as to cause it to oscillate transversely. As the box oscillates, so does the attached cam follower plate, which in turn causes the attached vanes to oscillate. By yet another aspect of the invention, the air sweep drive mechanism comprises a propeller mounted in the air discharge opening with its axis generally in alignment with the exiting air flow pattern. Its shaft is mechanically connected to the drive shaft, which, in turn, is connected to rotate the cam member. The propeller is upstream of the vanes and therefore substantially unaffected by their movement. As the discharge air flows through the opening, it aerodynamically engages the propeller and causes it to rotate to thereby provide the driving power for the air sweep drive mechanism. This continues until the actuator mechanism is caused to operate as discussed hereinabove, at which time the damper is moved against the blades of the propeller to thereby stop its rotational movement. In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
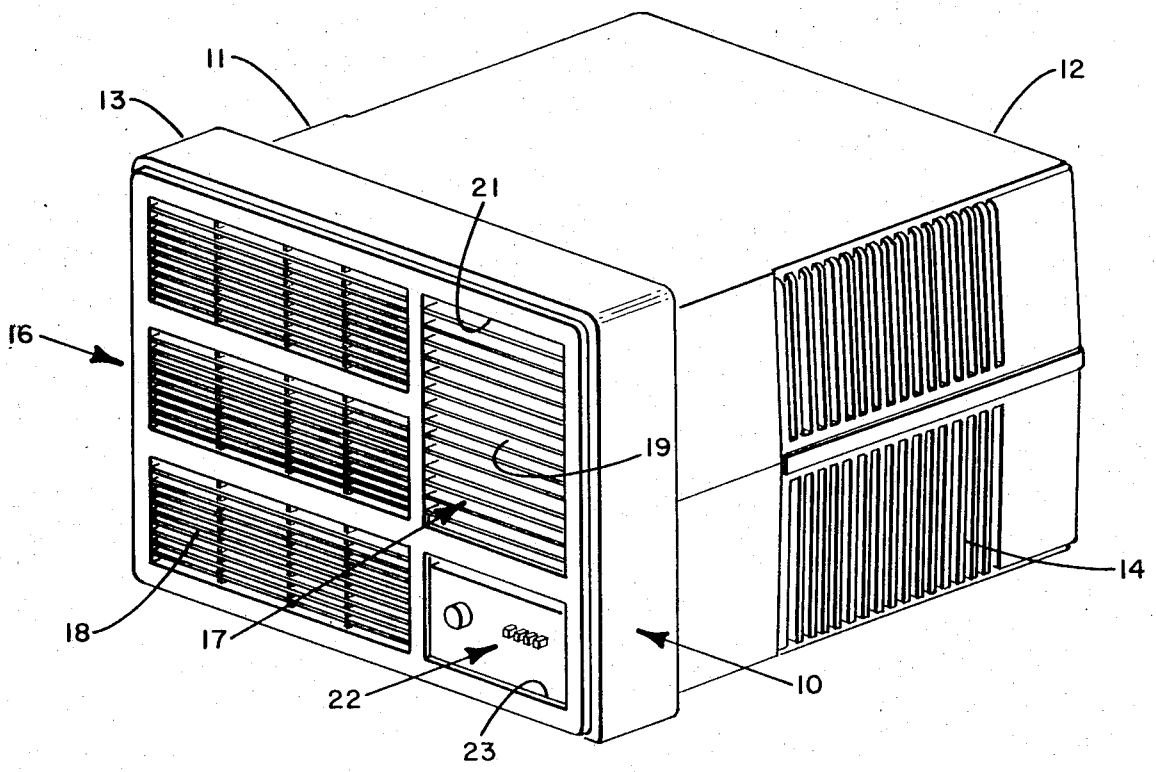
FIG. 1 is a perspective view of a room air conditioner with the present invention incorporated therein.

Referring now to FIG. 1, the invention is shown generally at 10 as part of an otherwise conventional room air conditioner unit 11 which includes a cabinet 12 and a front cover structure 13. The cabinet 12 houses an indoor section, nearest the front cover 13, and an outdoor section at the outer portion thereof. When the unit is in its installed position within a wall opening, the outdoor portion thereof operates by way of the condenser fan to draw outdoor air in through the air intake openings 14, through the condenser coil and out the discharge openings at the rear (not shown).

On the indoor side, the warm room air is drawn in through the return air opening 16 to pass through the evaporator coil to be cooled and then discharged from the air discharge opening 17. The return air opening 16 is covered by fixed louvers 18 that are integrally attached to the front cover structure 13, while the air discharge opening 17 is filled with the air discharge assembly structure of the present invention, such structure being separate from, but surrounded by the rectangular framework 21 of the front cover structure 13. Similarly, the control panel 22 is a separate component which is installed in the indoor section and then surrounded by the rectangular framework 23 of the front cover structure 13.

Figure 2:
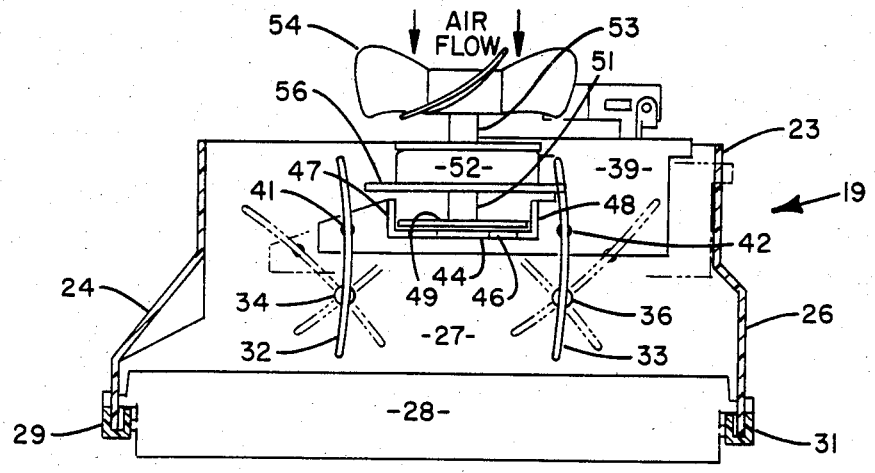
FIG. 2 is a top view of the air discharge louver mechanism with the top wall removed therefrom.

Referring now to FIG. 2, the air discharge assembly 19 is shown to include an outer housing 23 which forms the framework to be installed in the air discharge opening 17. The housing 23 comprises side walls 24 and 26, lower wall 27 and an upper wall which has been removed and is therefore not shown. Mounted between, and near the forward ends, of the side walls 24 and 26 are a plurality of horizontally disposed louvers 28 which are secured by way of retainer bars 29 and 31. The louvers 28 can be angularly adjusted on their horizontally disposed axes to vary the direction of the air flow in the vertical plane.

Variation of the air flow patterns within the horizontal plane is provided by a pair of vertically disposed vanes 32 and 33 which are mounted on their vertical axes 34 and 36 between the lower wall 27 and the upper wall (not shown). Collars 37 and 38 (see FIG. 3) are provided at the lower end of the vanes 32 and 33 to maintain proper clearance for free movement of the vanes 32 and 33 between the upper and lower walls. As will be seen in FIG. 2, the vanes 32 and 33 are operable over a range of approximately 90° as indicated by the dotted line extreme positions shown.

Rotation of the vanes 32 and 33 is brought about by the transverse movement of a cam follower plate 39 to which the vanes 32 and 33 are attached by depending pins (not shown) which extend downwardly through holes 41 and 42, respectively. The cam follower plate 39 is vertically supported by an integral base 43 (see FIG. 3) which rests on the surface of the lower wall 27, in frictional engagement therewith, to allow the cam follower plate to move between the extreme transverse positions shown in dotted line in FIG. 2. Also, integrally connected to the cam follower plate 39, and extending upwardly therefrom, is a cam follower box 44 comprising a front wall 46 and vertical side walls 47 and 48. The two extreme transverse positions of the cam follower box 44 are shown in dotted line in FIG. 3.

Located within the cam follower box 44 is a circular cam 49 which is mounted on a shaft 51 at an off center position as shown. The shaft 51 is drivingly connected to a gear box 52, which in turn is drivingly connected by the shaft 53 to the propeller 54. The gear box 52 is supported by a bracket 56 (see FIG. 4) which is attached to the housing lower wall 27 by a fastener (not shown).

In operation, the flow of discharge air through the housing 23 causes the propeller 54 and attached shaft 53 to rotate and drive the gear box 52. The attached shaft 51 is thereby rotated to drive the cam 49, which in turn causes the cam follower box 44 to oscillate transversely. The attached cam follower plate 39 also oscillates to thereby rotate the vanes 32 and 33 on their vertical axes to thereby sweep the air flow in the horizontal plane.

Figure 4:
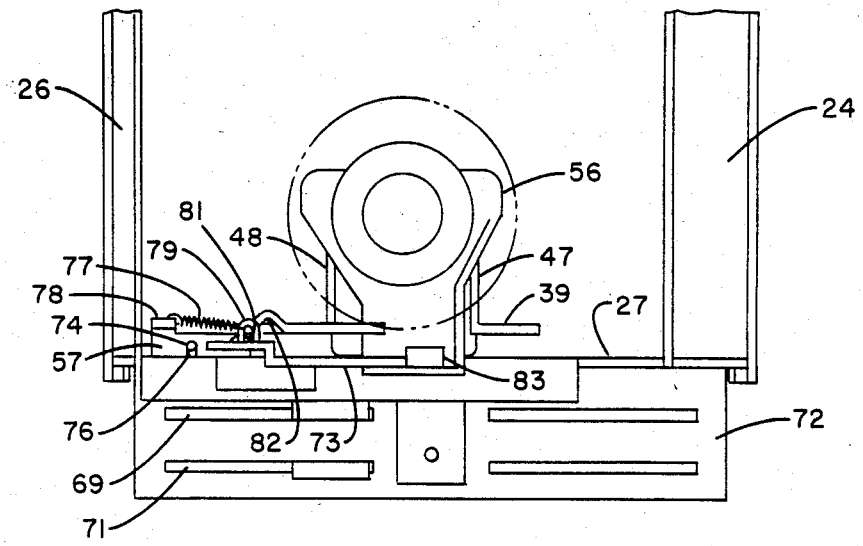
FIG. 4 is a rear view thereof.
Figure 5:
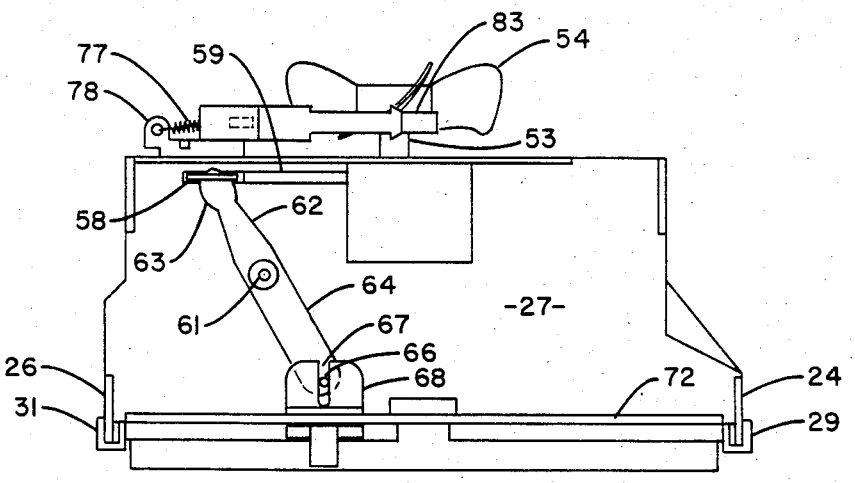
FIG. 5 is a bottom view thereof.

Referring now to FIGS. 4 and 5, the stop mechanism for stopping the sweep of the vanes 32 and 33 at a particular desired orientation will now be described. A slider 57 is mounted under the cam follower plate 39 with a depending loop 58 extending downwardly through a slot 59 in the lower wall 27. Rotatably mounted on a shaft 61 on the under side of the lower wall 27 is a lever 62 whose one end 63 passes through the loop 58 and whose other end 64 is attached by a pin 66 to the slot 67 of a selector 68. The selector 68 is slideably mounted in the two slots 69 and 71 in the front plate 72 which is integrally attached to and depends from the housing lower wall 27. A sliding of the selector 68 in the slots 69 and 71 causes the lever 62 to rotate on the shaft 61 to thereby move the loop 58 within the slot 59, which in turn causes the slider 57 to move transversely in the opposite direction from the selector, across the inner surface of the lower wall 27.

Attached to the slider 57 is an actuator arm 73. Attachment is made by a pivot pin 74 rotatably mounted in a hole 76 of the slider 57, and by a tension spring 77 which interconnects eyelets 78 and 79 on the slider 57 and actuator arm 73 respectively. The tension spring 77 tends to bias the actuator arm 73 upwardly from the pivot pin 74. Disposed on the upper surface of the actuator arm 73 is a protrusion 81 which frictionally engages the lower surface of the cam follower plate 39. Thus, the tension spring 77 tends to maintain the protrusion 81 against the bottom surface of the cam follower plate 39. In normal operation, the cam follower plate 39 will thus slide transversely over the slider protrusion 81 until the actuator mechanism is caused to operate.

Formed in the cam follower plate 39 is an upwardly extending notch 82 into which the actuator arm protrusion 81 will project if the two elements are vertically aligned. When this occurs, the actuator arm is caused by the tension spring 77 to pivot farther in the counterclockwise direction. A damper 83 on the free end of the actuator arm 73 is thus caused to move upwardly into the path of the propeller 54 to thereby stop its further rotation. The driving force for the sweep drive mechanism is thereby shut down so that the vanes 32 and 33 will remain in their fixed positions. They will remain in those fixed positions until the selector 68 is moved to thereby cause the protrusion 81 to be moved transversely with respect to the cam follower plate 39 to thereby allow it to be disengaged from the notch 82. When that occurs, the actuator arm 73 will be caused to rotate slightly in a clockwise direction such that the damper 83 will become disengaged from the propeller 54 and allow it to again rotate to drive the sweep mechanism.

Figure 3:
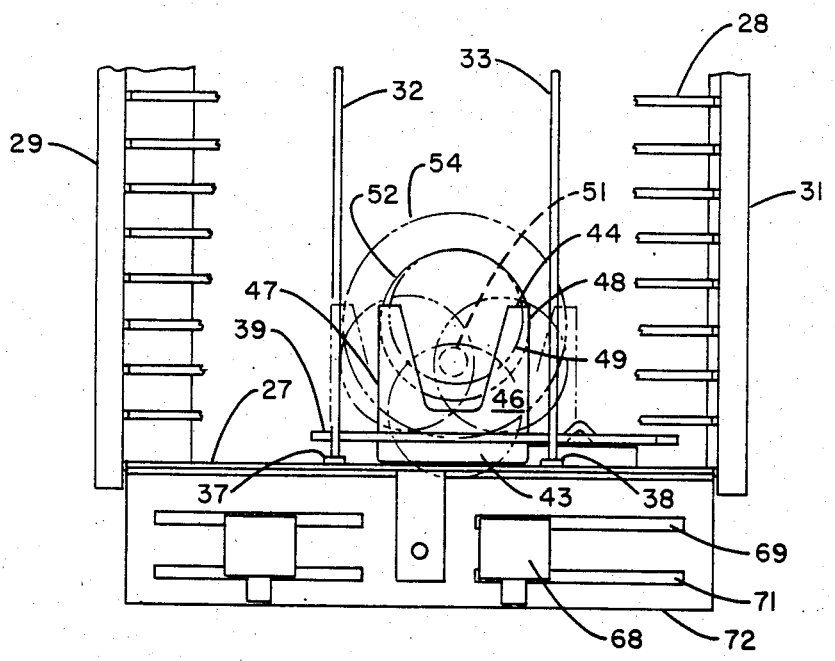
FIG. 3 is a front view thereof.

Continuous operation of the sweep mechanism can be obtained by moving the selector 68 to the extreme right ends of the slots 69 and 71 i.e., to the opposite end of that as shown in FIG. 3. This will cause the loop 58 to move to the extreme right of the slot 59 shown in FIG. 5 to thereby move the actuator arm protrusion 81 to a position which is outside the range of the notch 82 as it oscillates transversely during normal sweep operation. When it is desired that the sweep be discontinued with the airflow directed in a particular direction, the selector 68 can simply be moved to the left to a position which corresponds to the desired direction of flow. For that purpose, indicia may be included on the front plate 72 to show the relationship between the position of the selector 68 and the corresponding angular position of the vanes 32 and 33.

It will be understood that while the present invention has been described in terms of a preferred embodiment, it may take on any number of other forms while remaining within the scope and intent of the invention.

What is claimed is:

1. An improved air flow directing apparatus for an air conditioning system of the type having an air discharge opening with pivotable vanes mounted therein for directing the flow of discharge air into an adjacent space comprising:

vane pivoting means for pivoting the vanes in reciprocating fashion through a defined angle;

means including a preselector element for preselecfing a fixed angular orientation for the vanes by adjusting, independently of the position of the vanes at the time, the position of said preselector element to a position representative of said preselected orientation; and stop means responsive to said preselecting means for automatically stopping the pivoting of the vanes when they subsequently arrive at said preselected fixed singular orientation.

2. An air flow directing apparatus as set forth in claim 1 wherein said vane pivoting means comprises a drive mechanism which is mechanically connected to said vanes.

3. An air flow directing apparatus as set forth in claim 2 wherein said stop means operates to stop said drive mechanism.

4. An air flow directing apparatus as set forth in claim 2 wherein said drive mechanism comprises a propeller mounted in the air discharge opening, said propeller having its axis generally in alignment with the flow of discharge air.

5. An aif flow directing apparatus as set forth in claim 4 wherein said stop means includes a damper which is moved against said propeller to cause it to stop turning.

6. In an air conditioning apparatus of the type having an air discharge opening with vanes that automatically rotate from side to side with the purpose of sweeping the air flow pattern between two extreme angled positions, an improved mechanism for setting the vanes at a desired fixed orientation comprising:

a drive mechanism for providing continuous pivoting motion to the vanes;

means including a preselector element, for preselecting a desired position of fixed orientation for the vanes by adjusting, independently of the position of the vanes at the time, the position of said preselector element to a position representative of said preselected orientation; and stop means responsive to said preselection means for causing said drive mechanism to stop when the vanes are subsequently pivoted by said drive mechanism to said desired position.

7. The mechanism as set forth in claim 6 wherein said dtive mechanism includes a propeller which is mounted in the air discharge opening, said propeller having its axis in general alignment with the air flow pattern.

8. The mechanism as set forth in claim 7 wherein said stop means includes a damper which is automatically moved against said propeller to cause it to stop turning.

9. The mechanism as set forth in claim 6 wherein said selecting means can be so positioned as to not cause said stop means to be operable.

* * * * *